United States Patent [19]

Kelley et al.

[11] Patent Number: 4,561,371

[45] Date of Patent: Dec. 31, 1985

[54] CATAMARAN STABILIZATION STRUCTURE

[76] Inventors: Richard L. Kelley, 39 Roosevelt St.; Frederick W. Holbrow, 25 Congress St., both of, Braintree, Mass. 02184

[21] Appl. No.: 631,543

[22] Filed: Jul. 16, 1984

[51] Int. Cl.[4] ..... B63H 9/00

[52] U.S. Cl. ..... 114/61; 114/127; 114/274

[58] Field of Search ..... 114/61, 39, 127–137, 114/140, 141, 274, 280

[56] References Cited

U.S. PATENT DOCUMENTS

| | | | |
|---|---|---|---|
| 3,747,138 | 7/1973 | Morgan | 441/74 |
| 3,841,251 | 10/1974 | Larson | 114/39 |
| 3,885,512 | 5/1975 | Marcil | 114/39 |
| 4,027,614 | 6/1977 | Jones | 114/61 |
| 4,037,279 | 7/1977 | Ziebart | 114/127 |
| 4,164,909 | 8/1979 | Ballard | 114/274 |
| 4,345,538 | 8/1982 | Warner | 114/274 |

FOREIGN PATENT DOCUMENTS

| | | | |
|---|---|---|---|
| 2449030 | 10/1980 | France | 114/127 |

*Primary Examiner*—Galen L. Barefoot
*Assistant Examiner*—C. T. Bartz
*Attorney, Agent, or Firm*—John P. McGonagle

[57] ABSTRACT

A catamaran stabilization structure for catamaran sailboats which includes a centerboard and dagger-boards. The centerboard has a double wing stabilizer with adjustable pitch. The dagger-boards protrude through each of the hulls. Each dagger-board has a single wing stabilizer.

2 Claims, 3 Drawing Figures

CATAMARAN STABILIZATION STRUCTURE

BACKGROUND OF THE INVENTION

This invention relates to catamaran sailboats and particularly to a catamaran stabilization structure.

Catamarans are light weight sailboats with two parallel hulls. These boats are fast, maneuverable and easy to handle. They have, however, one decided drawback. These boats are subject to extreme tilting in a strong breeze. This requires the user or passengers to shift from side to side, and in some instances, the catamaran may actually overturn in a particularly strong gust of wind.

The prior art includes various patents pertaining to stabilization structures for catamarans but none of these disclose a structure with the degree of stabilization of the present invention. U.S. Pat. No. 595,161 to J. W. Gibb discloses a centerboard for boats with two blades which are alternately and automatically brought into position opposed to the boat's drift. The centerboard automatically shifts its angle to the keel with the list of the hull, so as to present a practically perpendicular face to the direction of drift.

U.S. Pat. No. 3,077,850 to W. C. Beuby discloses a catamaran directed, trimmed and stabilized longitudinally by means of a pair of guidance and stabilizing hydrofoils located at the bow of the hulls. The boat also has a deck mounted centerboard and hull mounted centerboards. U.S. Pat. No. 3,841,251 to R. W. Larson discloses a deck with two centerboards, one located near each of the two hulls. Each of the hulls is pivotally connected to the deck so that the hull engaging the water remains substantially parallel to the water surface regardless of the inclination of the desk.

U.S. Pat. No. 3,855,512 to P. M. Marcil discloses a keel structure extending downward from the mast. This assembly pivots in unison whereby the keel pivots in the direction opposite to the mast. U.S. Pat. No. 4,027,614 discloses a catamaran with antiheel devices. The devices consist of controllable stabilizers mounted on rudders. U.S. Pat. No. 4,284,024 discloses a catamaran with two dagger-boards. Each of the dagger-boards is located on either side of the deck near to each hull.

In a preferred arrangement the present invention comprises a relatively simple catamaran stabilization structure consisting of a centerboard with a double wing stabilizer, and a dagger-board with a single wing stabilizer protruding through each of the hulls. The centerboard stabilizer is rippled for increased stability. The centerboard pitch is adjustable.

Accordingly, an object of this invention is to provide a new and improved catamaran stabilization structure.

Another object of this invention is to provide a stabilization structure which is easy to use and is removable.

A more specific object of this invention is to provide a new and improved catamaran stabilization structure which includes a centerboard with a double wing stabilizer and dagger-boards with single wing stabilizers through the hulls.

DETAILED DESCRIPTION OF THE INVENTION

Figure 1:
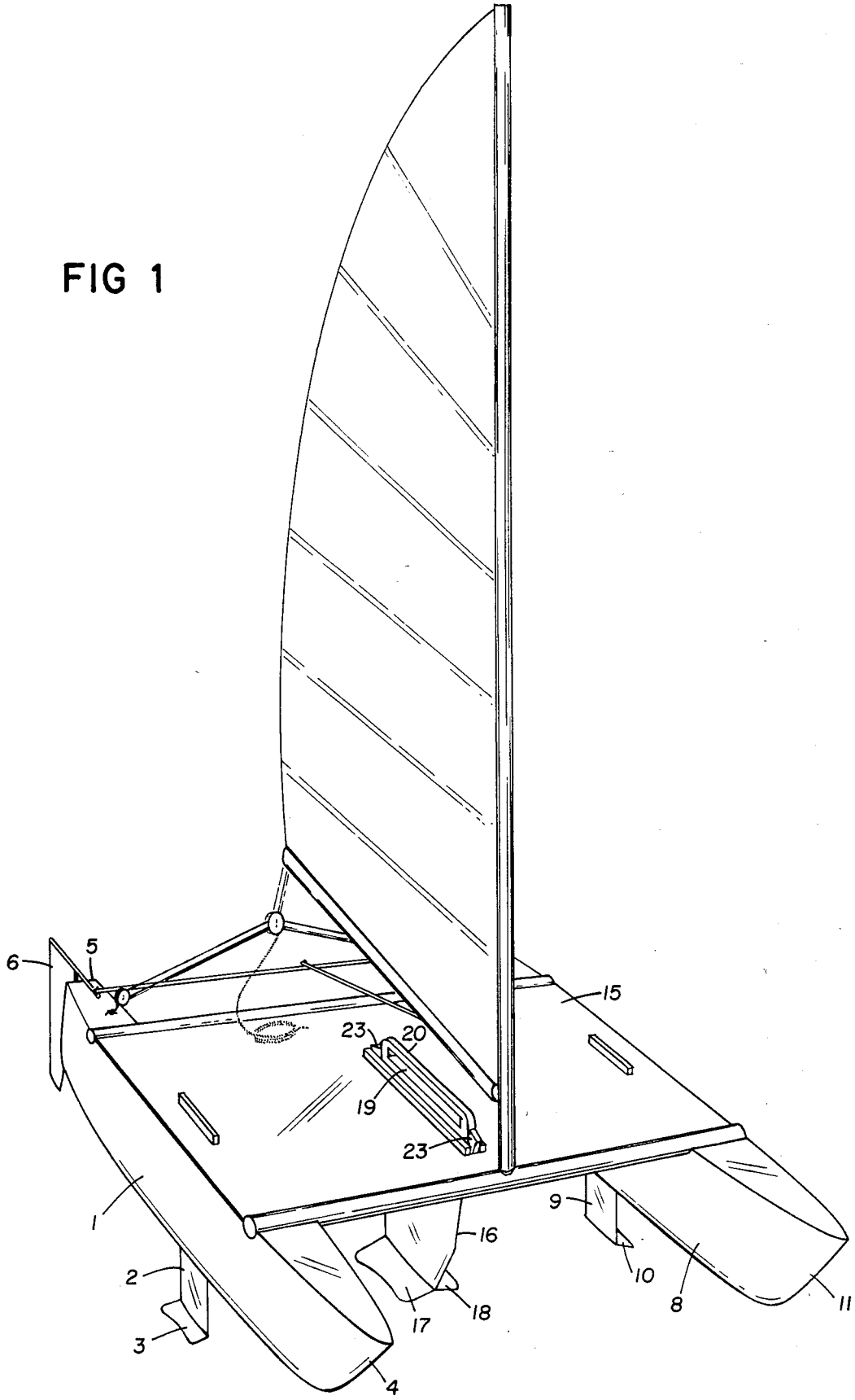
FIG. 1 is a perspective view of a catamaran according to the invention showing the centerboard and dagger-boards with stabilizers.
Figure 2:
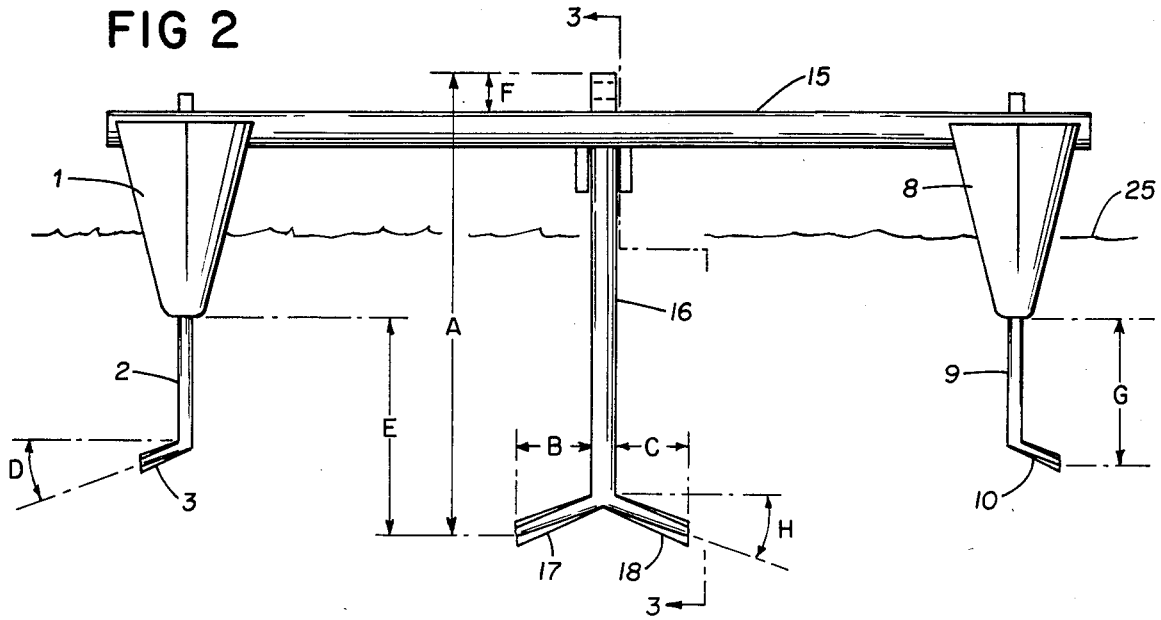
FIG. 2 is a front elevational view of FIG. 1.

Referring now to the drawings, FIG. 1 is a perspective view of one embodiment of a catamaran according to the present invention. FIG. 2 is a front elevational view of the same catamaran. The catamaran shown in these figures has the standard twin hulls 1 and 2 with interconnecting bracing and decking 15. The stabilization structure includes a centerboard 16 protruding through the decking 15 and dagger-boards 2 and 9 protruding through the hulls 1 and 8.

The centerboard 16 terminates in two wings 17 and 18 which are positioned beneath the water surface 25. The dagger-boards 2 and 9 end in single wings 3 and 10 respectively.

Figure 3:
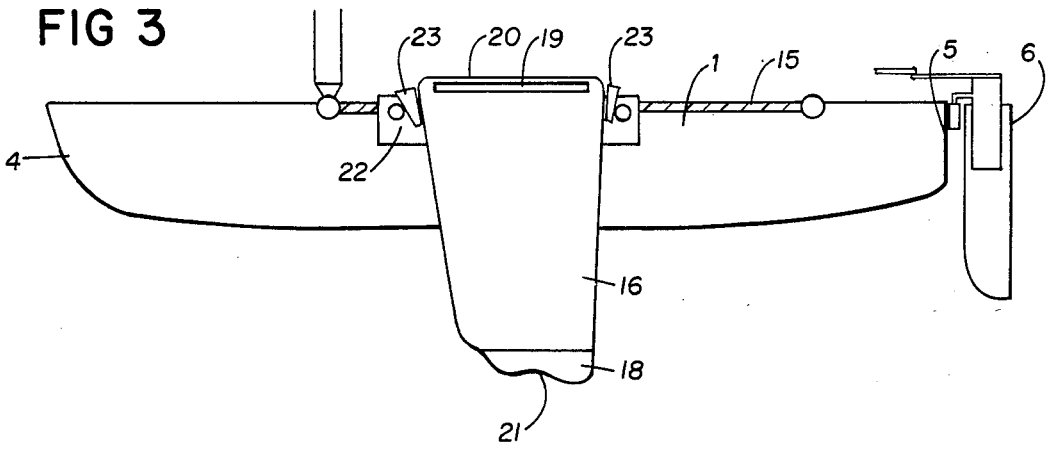
FIG. 3 is a longitudinal section taken on the plane of the line 3—3 of FIG. 2.

FIG. 3 is a side elevational view of a catamaran according to the present invention along the plane of line 3—3 of FIG. 2. The right hull 1 with rudder 6 is visible, however the right Dagger-board 2 is not, nor is the single wing 3 visible. The centerboard 16 has a hand grip opening 19 near its top 20. The centerboard bottom 21 terminates in double wings 17 and 18, the left one 18 of which is visible. The wings 17 and 18 are slightly swept back from the bow 11 in the direction of the stern 12. The wings 17 and 18 are also rippled for less resistance to water. The deck opening 22 through which the centerboard 16 is fitted is larger than that needed by the centerboard 16. This permits adjustments in the centerboard's 16 pitch in relationship to the bow 11 and stern 12. The adjustments are made by inserting various sized wedges 23 forward and aft of the centerboard 16 within the centerboard deck opening 22 from the direction of the centerboard top 22.

FIG. 2 shows the relationship among the various elements of the catamaran stabilization structure. With a catamaran of 22 feet bow to stern and having a mast height of 35 feet, a centerboard 16 with a length A of up to six feet would be used. The value of E is approximately one-half of A. The value of G is approximately two-thirds of E. The values of B and C are identical and may be up to one foot each. The values of D and H are approximately 30°.

OPERATION

When the catamaran is in use, the centerboard 16 and dagger-boards 2 and 9 are all in fully extended positions. The boat is especially stable in a wind gust environment. From FIG. 2 it can be seen that a sudden gust of wind from the port side to the starboard side will cause the following actions and reactions. With an ordinary catamaran the port hull 8 would rise and the entire boat would rest and balance on the starboard hull 1. If the wind gust were strong enough, the boat could completely overturn. At the very least, the users and/or passengers would be required to shift their weight to compensate for the wind's force.

With a catamaran according to the present invention the stabilization structure immediately reacts against the wind gust. The port dagger-board 9 and the single wing 10 resist the upward inclination of the port hull 8. The centerboard 16 and its double wings 17 and 18 hold the boat down by acting as a sea anchor.

During a turn boats tend to skid sideways in the direction opposite to the direction from which the wind is coming. If the boat in FIG. 2 were to make a sudden turn to port, the starboard hull 1 dagger-boards 2 and wing 3 would block the skid while the centerboard 16 and port dagger-board 9 structures would hold the boat down on the water surface 25. The stabilization structure of the present invention will, therefore, allow much tighter turns than conventional catamarans.

It is understood that the above-described embodiment is merely illustrative of the application. Other embodiments may readily be devised by those skilled in the art which will embody the principles of the invention and fall within the spirit and scope thereof.

We claim:

1. In a catamaran sailboat with a bow and stern that includes a pair of laterally spaced parallel hulls and interconnecting bracing and decking secured to said hulls, a catamaran stabilization structure comprising:

a longitudinal opening in the decking intermediately disposed between the hulls having a forward end and an aft end corresponding to the bow and stern respectively;

a centerboard, protruding through said longitudinal opening, having a deck end which terminates in a handle and is positioned above the decking, and a water end which terminates in a double wing stabilizer approximately perpendicular to the centerboard and positioned beneath the water surface which stabilizer wings are slightly swept back from the bow in the direction of the stern and are rippled from bow to stern;

a pair of dagger-boards each of which protrudes through a hull; and a plurality of various sized wedges for adjusting the pitch of the centerboard stabilizer which are inserted forward and aft of the centerboard deck end within the centerboard deck opening.

2. A catamaran stabilization structure in accordance with claim 1 wherein:

each dagger-board has a deck end which is positioned above the hull, and a water end which terminates in a single wing stabilizer approximately perpendicular to the dagger-board on the side of the dagger-board away from the other dagger-board and is positioned beneath the water surface.

* * * * *